United States Patent [19]

Kobayashi

[11] 4,259,566

[45] Mar. 31, 1981

[54] HAIR WAVING APPLICANCE HAVING PLURAL INDEPENDENTLY TEMPERATURE CONTROLLABLE ELECTRIC HEATERS

[75] Inventor: Takehiro Kobayashi, Sakai, Japan

[73] Assignee: Sharp Kabushiki Kaisha, Osaka, Japan

[21] Appl. No.: 866,822

[22] Filed: Jan. 4, 1978

[30] Foreign Application Priority Data

Apr. 30, 1977 [JP] Japan ..... 52-56906

[51] Int. Cl.[3] ..... H05B 1/02; A45D 20/40; H01C 1/01

[52] U.S. Cl. ..... 219/222; 34/4; 34/90; 34/96; 34/99; 132/7; 132/9; 219/358; 219/505; 219/516; 338/22 R; 338/28

[58] Field of Search ..... 219/222, 224, 226, 483, 219/486, 504–505, 508, 516, 354, 358, 449, 450; 132/7, 9; 34/3–4, 48, 90–91, 96, 99, 101, 243; 338/22 R, 22.5 D, 23, 25, 28

[56] References Cited

U.S. PATENT DOCUMENTS

| | | | |
|---|---|---|---|
| 2,104,563 | 1/1938 | Kurlbaum | 219/483 |
| 2,264,814 | 12/1941 | Stanley | 132/9 X |
| 2,822,455 | 2/1958 | Molyneaux et al. | 219/504 |
| 3,062,941 | 11/1962 | White | 219/505 |
| 3,417,226 | 12/1968 | Thomiszer | 219/469 |
| 3,646,319 | 2/1972 | Auld | 219/358 X |

FOREIGN PATENT DOCUMENTS

| | | | |
|---|---|---|---|
| 1059160 | 6/1959 | Fed. Rep. of Germany . | |
| 994804 | 8/1951 | France | 132/9 |
| 1139596 | 7/1957 | France | 338/22 |
| 1178273 | 5/1959 | France | 34/99 |

*Primary Examiner*—A. Bartis

*Attorney, Agent, or Firm*—Birch, Stewart, Kolasch & Birch

[57] ABSTRACT

A hair waving appliance includes a head receiving and confining assembly provided with a plurality of independently controllable electric heaters for heating different hairline areas of the head received therein. A plurality of temperature sensing probes, each associated with a respective one of the independently controllable heaters, are connected to a temperature control means for controlling the heating of the respective heaters. Each probe includes a temperature sensitive element enclosed in a spherical shell carried at the end of an elongated spring-biased cord or flexible pipe. The probes extend into the interior of the head receiving and confining assembly and are arranged to adaptably contact the hair on the respective portions of the head. The spherical members have a size at least equal to the size of the curler rods used to curl the hair. The appliance includes means for generating moisture-laden air at room temperature to impart moisture to the hair being treated.

16 Claims, 4 Drawing Figures

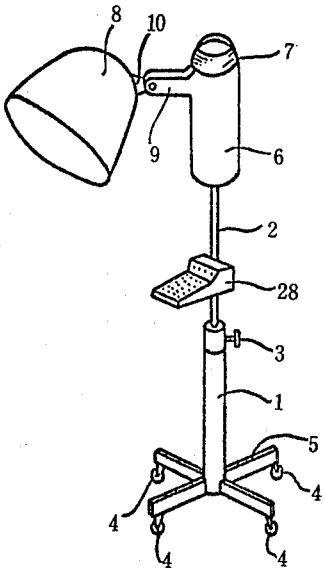
FIG. 1
FIG. 4
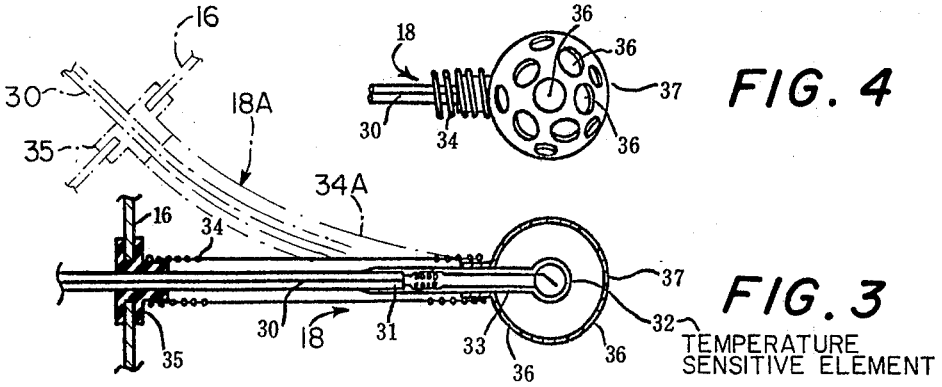
FIG. 3

HAIR WAVING APPLICANCE HAVING PLURAL INDEPENDENTLY TEMPERATURE CONTROLLABLE ELECTRIC HEATERS

BACKGROUND OF THE INVENTION

The present invention relates generally to a heating type hair waving appliance.

A conventional way to confer a durable hair wave is to allow a waving agent to react on hair at room temperature. This is called "cold waving." However, in this instance the waving agent, for example, thioglycolate, should be strong because it reacts on hair at room temperature. There is a great risk that the waving agent will damage the skin of a beautician and the hair of a patron. In addition, since the period where the waving agent reacts on the hair is determined primarily by the judgement and experience of a beautician, the degree of hair waving is occasionally too much or too little. Lately, some approaches to overcome the defects noted above have been suggested, that is, the use of heating types of hair waving appliances wherein hair is heated before the reaction of a waving agent. One method of waving hair involves curling the hair about heated curler rods to heat the hair and allow a waving agent to react on the hair. An alternative method of waving hair involves supplying hot air to hair containing a waving agent to heat the hair during the reaction of the waving agent. See, for example, German Pat. No. 1059160 issued on Apr. 26, 1962 and No. 1079801 issued on Sept. 13, 1962.

While these prior art appliances were provided with temperature sensors for providing a control for temperatures of the heater elements contained therein, the temperature sensors were adapted to sense the temperature of the atmosphere within a head supporting assembly. Therefore, the prior art sensors could not provide accurate detection of the hair itself.

SUMMARY OF THE INVENTION

Accordingly, the present invention overcome all the disadvantages noted with respect to the above outlined prior art devices by providing an improved temperature sensing probe.

Pursuant to the teachings of the present invention, a temperature sensing probe for use in the heating type of a hair waving appliance having at least one heater element carries a temperature sensitive element, such as a negative characteristic thermistor, for the purposes of controlling the temperature of the heater. The temperature sensing probe is made with an adaptable resilient construction which can comply with the curved surface of the respective hairline areas of the head in a manner to accurately sense the temperature of hair itself. The adaptable construction of the temperature sensing probe includes a spring loaded rigid cord, and a flexible tubing. In one preferred form, the temperature sensing probe comprises a spherically shaped housing for accommodating the temperature sensitive element, the size of the spherically shaped housing being equal to or greater than the diameter of a curler rod on which hair is curled.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

A better understanding of the invention may be had from a consideration of the following detailed description taken in conjunction with the accompanying drawings in which:

FIG. 1 is a perspective view of a hair waving applicance;

FIG. 3 is a cross sectional view of a temperature sensing probe of the present invention used with the hair waving appliance as shown in FIGS. 1 and 2; and FIG. 4 is a perspective view of the temperature sensing probe shown in FIG. 3.

DETAILED DESCRIPTION OF THE INVENTION

Figure 2:
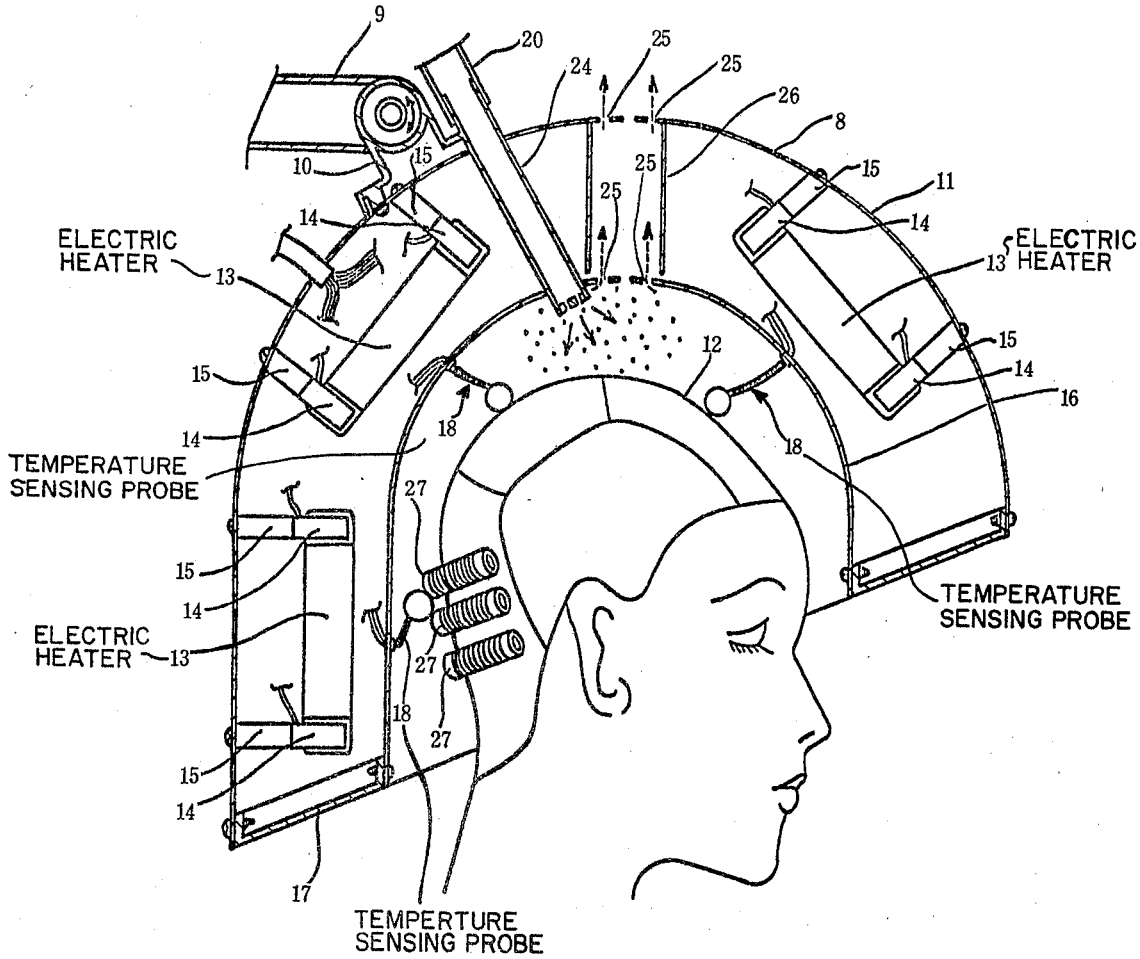
FIG. 2 is an enlarged fragmentary cross sectional view of the hair waving applicance as shown in FIG. 1.

The temperature sensing probe embodying the present invention is most applicable to a heating type hair waving appliance disclosed and claimed in co-pending U.S. Pat. application, Ser. No. 862,964 filed Dec. 21, 1977, which patent application is owned by a common assignee with the present application and incorporated herein by reference. The hair waving appliance is adapted such that a waving agent is allowed to react on the hair under a heated condition with a controlled temperature and duration of the reaction and moisture is imparted to the hair by a moisture-laden air-mist mixture dissipated at room temperature by an ultrasonic atomizer. It is obvious to those skilled in the art that the temperature sensing probe of the present invention is equally applicable to other heating types of hair waving appliances.

Attention is initially called to FIGS. 1 and 2 of the drawings which illustrate a heating and moisturing type hair waving appliance. This includes a standing prop 1 through which the position of a slidable tube 2 is adjustable by means of a screw 3. The standing prop 1 rests on a pedestal 5 which is arbitrarily movable on the floor by means of casters 4.

An appliance body 6 is tightly secured about the upper end of the tube 2, which carries a blower, an ultrasonic atomizer, etc. A water replenish tank 7 is removably installed within the upper portion of the applicance body 6. A head receiving and enclosing helmet assembly 8 is rotatably retained on a support 9 of the appliance body 6 through a helmet holder 10, which contains a hemispherically shaped helmet shell 11. The shell 11 supports a predetermined number of heater elements 13 such as incandescent lamps and infrared lamps are secured by holders 14, insulators 15, etc., in positions to correspond to respective hairline areas of the head of a user of the hair waving appliance. A hemispherically shaped protector 16 made of proper transparent plastic material is provided for protecting the respective heater elements 13 against the moisture-laden air mist mixture dispatched from the ultrasonic atomizer in body 6 (not shown). The protector 16 is installed by a spaced annular plate member 17 which also serves as a shield plate.

The head receiving and enclosing helmet assembly 8 further contains a predetermined number of temperature sensing probes 18 corresponding to the respective heater elements 13 and adapted to sense temperatures of the respective hairline areas being heated. As previously noted, each of the temperature sensing probes is made with an adaptable construction which will be best described with respect to FIGS. 3 and 4. A mist conduit 24 is further contained within the head supporting helmet assembly 8, which sends the moisture-laden air mist impelled via a connection hose 20 from the ultrasonic atomizer and the blower in appliance body 6 into the inside of the helmet assembly 8. A discharge assembly 26 is provided having orifices 25 to discharge hot air within the protector 16 to the outside. A plurality of curler rods 27 on which hair is curled are used to cover the whole hairline area 12.

A controller 28 rests on a table movable and slidable on the prop 1, which comprises a variety of components for controlling temperature and duration of the respective heater elements 13 in response to the temperature sensing probes 18 which sense the temperature of the surface of the hair curled on the curler rods 27, adjusting the amount of mist dissipated from the ultrasonic atomizer, controlling the power supply, etc.

In the above described temperature sensing probe 18, as shown in FIGS. 3 and 4, a temperature sensitive element 32, such as a negative characteristic thermistor, is connected to the end 31 of a lead wire 30 to provide access to the controller 28. A heat shrinkable tube 33 imparts the moisture-proof property to the temperature-sensitive element 32 itself and a junction of the temperature-sensitive element 32 and the lead wire 30. A spring 34 which forms the above noted construction, is placed outside the lead wire 30. One end of the spring 34 is arrested by a bushing 35 secured in the protector 16, whereas the other end of the spring 34 is arrested by a spherical shell 37 for accommodating the temperature-sensitive element 32 therein. The spherical shell 37 has a multiplicity of apertures 36. The spring 34 is given elasticity by a proper selection of the spacing between the spherical shell 37 and the bushing 35.

The phantom lines shown in FIG. 3 illustrate a modification of the present invention wherein the temperature sensing probe 18A includes a flexible pipe 34A carrying the temperature sensitive element.

The mode of operation of the heating type hair waving appliance will be carried out in the following manner.

Hair of the hairline area 12 is wound about the curler rods 27 and then painted uniformly with the waving agent of which the intensity is weakened because of the heating and moisturizing type hair waving appliance used. The hairline area 12 is placed inside the helmet 8.

The heating temperature and the duration of heating of the respective heater elements 13 are preselectable by the operation of the controller 28. After confirming the amount of water of the replenish tank 7, a power switch and a start switch on the controller 28 are thrown. The hairline area 12 is heated up while the moisture-laden air mist enters the helment from the mist tube 24, thereby conferring durable hair waves. In this case, the protector 16 protects the respective heater elements 13 against the air mist dissipated from the conduit 24, preventing isolated deterioration in the heater elements 13. The protector 16 serves also to distribute the mist from the conduit 24 throughout the hairline area 12. The spherical shell 37 containing the temperature-sensitive element 18 is forced into close contact with the surface of hair of the hairline area 12 around the curler rods 27 under action of the spring. In other words, this always ensures the closely contacted relationship therebetween without regard to a difference from people to people in the size and shape of the hairline area 12 and the relative position of the hairline area 12 with respect to the helmet 8. Thus, the temperature sensitive element 18 within the probe accurately senses the temperature of the surface of hair curled on the curler rods 27. As a result, the temperatures of the hair of the hairline area 12 are exactly controlled by the respective temperature-sensing probes 18 and the controller 28.

Provided that the diameter of the spherical shell 37 of the temperature-sensing probe 18 is substantially equal to the diameter of the curler rods 27, this will prevent hair from being caught between the curler rods 27, concealed behind the curler rods 27, or interwined therebetween. It is obvious to those skilled in the art that a flexible pipe may be used to form an adaptable construction in place of the spring 34.

While certain representative embodiments and details have been shown for the purpose of illustrating the present invention, it will be apparent to those skilled in this art that various changes and modifications may be made without departing from the spirit or scope of the invention, and all such modifications as would be obvious to one skilled in the art are intended to be included within the scope of the following claims.

I claim:

1. A hair waving appliance comprising:

(a) a head receiving and confining assembly;

(b) a plurality of independently controllable heating means provided within said head receiving and confining assembly for heating different hairline areas of the head received and confined therein; and (c) a plurality of temperature sensing probes, each of said temperature sensing probes being associated with a respective independently controllable heating means and carrying a temperature sensitive element connected to a temperature control means for controlling the heating of said heating means, each of said temperature sensing probes extending into the interior of the head receiving and confining assembly and being arranged to contact the hair on different portions of the head received and confined in the assembly and being movably constructed to adapt to the curved surface of the hairline area of the head received in the head confining and receiving assembly.

2. The hair waving applicant as set forth in claim 1 wherein the temperature sensing probe comprises a spring-biased cord carrying said temperature sensitive element.

3. The hair waving appliance as set forth in claim 1 wherein the temperature sensing probe comprises a flexible pipe carrying said temperature sensitive element.

4. The hair waving applicant as set forth in claim 1 wherein said temperature sensing probe comprises a spherical shell, said temperature-sensitive element being contained in said spherical shell, and a spring-biased cord secured on the head receiving and confining assembly for carrying said shell and leading a signal from said temperature-sensitive element.

5. The hair waving appliance of claim 4, wherein the spherical shell is provided with a plurality of apertures.

6. The hair waving appliance of claim 1, wherein atomizer means are provided in the appliance for generating moisture-laden air mist at room temperature, thereby imparting moisture to the hair being heated by said heating means.

7. The hair waving appliance as set forth in claim 6 further comprising means associated with said probes for protecting said temperature sensing probes against the moisture-laden air mist dissipated from said atomizer means.

8. A hair waving appliance used for treating hair curled on curler rods comprising:

(a) a head receiving and confining assembly;

(b) at least one heating means provided within said head receiving and confining assembly for heating hair of the head of a user of said hair waving appliance;

(c) at least one temperature sensing probe, each carrying a temperature sensitive element connected to a temperature control for controlling the heating of said at least one heating means, said temperature sensing probe extending into the interior of the assembly and being arranged to contact the hair on the head received and confined in the assembly, said probe being movably constructed to adapt to the curved surface of the hairline area of the head confined in the assembly, the end of said probe having a size at least substantially equal to the size of the curler rods.

9. The hair waving appliance of claim 8, wherein the temperature sensing probe comprises a spring-biased cord carrying the temperature sensitive element.

10. The hair waving appliance of claim 8, wherein the temperature sensing probe comprises a flexible pipe carrying the temperature sensitive element.

11. The hair waving appliance of claim 8, wherein said temperature sensing probe comprises a spherical shell, said temperature sensitive element being contained in said spherical shell and a spring-biased cord secured on the head receiving and confining assembly for carrying said shell and leading a signal from said temperature sensitive element.

12. The hair waving appliance of claim 11, wherein the spherical shell is provided with a plurality of apertures.

13. The hair wave appliance of claim 8, wherein atomizer means are provided in the appliance for generating moisture-laden air mist at room temperature, thereby imparting moisture to the hair being heated by said heating means.

14. The hair waving appliance of claim 13, further comprising means associated with each of said temperature sensing probes for protecting said temperature sensing probes against the moisture-laden air mist dissipated from said atomizer means.

15. A hair waving appliance comprising (a) a head receiving and confining assembly constructed to conform to the head of a user while maintaining a gap therebetween;

(b) a plurality of independently controllable heating means provided within said head receiving and confining assembly for heating different hairline areas of the head of the user;

(c) a plurality of temperature sensing probes, each of said temperature sensing probes being associated with a respective independently controllable heating means and carrying a temperature sensitive element connected to a temperature control means for controlling the heating of said heating means, each of said temperature sensing probes being movably constructed and located within the confines of the head receiving and confining assembly and being arranged to contact the hair of a head inserted into the assembly;

(d) means for introducing a moisture-laden air mist mixture into the gap provided between the head receiving and confining assembly and the head of the user;

(e) protector means associated with said head receiving and confining assembly for protecting the respective heating means against the moisture-laden air mist mixture; and (f) a discharge assembly communicating with said gap for removing hot air from the gap to the environment.

16. The hair waving appliance of claim 15, wherein the temperature sensing probes are spring-biased.

* * * * *